United States Patent [19]

Solomon

[11] 4,012,731

[45] Mar. 15, 1977

[54] BURGLAR ALARM SYSTEM

[76] Inventor: Anna Grace Solomon, 3611 Kalsman Drive, Los Angeles, Calif. 90016

[22] Filed: Jan. 5, 1976

[21] Appl. No.: 646,831

[52] U.S. Cl. ..... 340/274 R; 340/271; 335/205; 200/61.62

[51] Int. Cl.[2] ..... G08B 13/08

[58] Field of Search ..... 340/274, 276, 282, 283, 340/273, 271; 200/61.52, 61.54, 61.62, 61.39, 61.93; 335/205

[56] References Cited

UNITED STATES PATENTS

| | | | |
|---|---|---|---|
| 2,874,240 | 2/1959 | Ricks | 340/274 X |
| 3,327,300 | 6/1967 | Birrenkott | 340/274 X |
| 3,760,312 | 9/1973 | Shlesinger | 335/205 |

*Primary Examiner*—John W. Caldwell
*Assistant Examiner*—William M. Wannisky
*Attorney, Agent, or Firm*—Henry M. Bissell

[57] ABSTRACT

The improved burglar alarm system of the present invention includes a housing which is secured around a doorknob rotatably mounted on a door. The doorknob shaft extends out through an opening in the housing. A magnet is positioned on the shaft and aligned with a magnetic field-responsive switch in the housing so that the switch is held open only when the shaft is in the fully unrotated resting position. The switch is part of a circuit which includes a power source, such as a battery, and an annunciator, such as a buzzer or horn. The power source is connected to the circuit through an "on-off" switch accessible through the housing to activate the system.

A pointer or the like indicates the resting, fully unrotated position of the shaft, preferably by reference to the magnet, and preferably conceals the magnet. This simple, compact inexpensive system utilizing only a single, inexpensive magnet-responsive switch detects surreptitious rotation of the doorknob shaft in either direction, as by a thief or burglar, when the system is activated and announces this act via a horn, buzzer, etc. to warn the occupants or residents of the house, store, etc. where the alarm is installed.

8 Claims, 3 Drawing Figures

BURGLAR ALARM SYSTEM

BACKGROUND OF THE INVENTION

1. Field of the Invention.

The present invention generally relates to protection systems and more particularly to an improved door burglar alarm system.

2. Description of the Prior Art.

Certain conventional burglar alarm systems for doors are quite complicated, bulky and expensive. Only a few are designed to be used in detecting surreptitious movement of a doorknob. Of these designed for that purpose, several require complicated and expensive electrical circuitry, including a plurality of switches, one or more for each direction of rotation of the doorknob. Certain others encumber the doorknob with clumsy hanging weights and the like. Still others provide plunger pins and other friction devices which are difficult and/or unsightly to install and may hinder rotation of the doorknob.

Accordingly, there remains a need for a simple, easily installed, inexpensive, attractive and highly effective means for detecting surreptitious rotation of doorknobs, which means should not in any way interfere with normal operation of the door and should encourage extensive use by homeowners, storekeepers, etc., particularly in view of the number of burglaries of both homes and businesses.

SUMMARY OF THE INVENTION

The present invention satisfies the foregoing needs. The improved burglar alarm system of the invention is substantially as set forth in the Abstract above. It includes a single simple magnet-responsive switch held open by a magnet when the doorknob is in the freely resting unrotated position, but closed when the doorknob is rotated at all in either direction from this position. Such closing causes an annunciator to buzz, ring, blare or the like, powered by an electrical power means, such as batteries. The system can be activated or inactivated by the "off-on" switch to conserve the power source when not intended to be in use. An indicator preferably conceals the magnet and indicates the position of the knob i.e., whether it is in fact in the fully resting position or not, as by reference to a horizontal or vertical alignment or the like. The switches, annunciator and power source are disposed in a compact, attractive housing which fits around the knob and can be installed in a few seconds, saving time and effort and imparting a decorative appearance to the door. The magnet can also be installed on the doorknob shaft in a few seconds, thus completing the improved alarm system. The power means is readily accessible through the housing for replacement. The "off-on" switch is readily accessible through the housing for activating and deactivating the system. Further features of the improved system are set forth in the following detailed description and accompanying drawings.

DESCRIPTION OF THE PREFERRED EMBODIMENT

Figure 1:
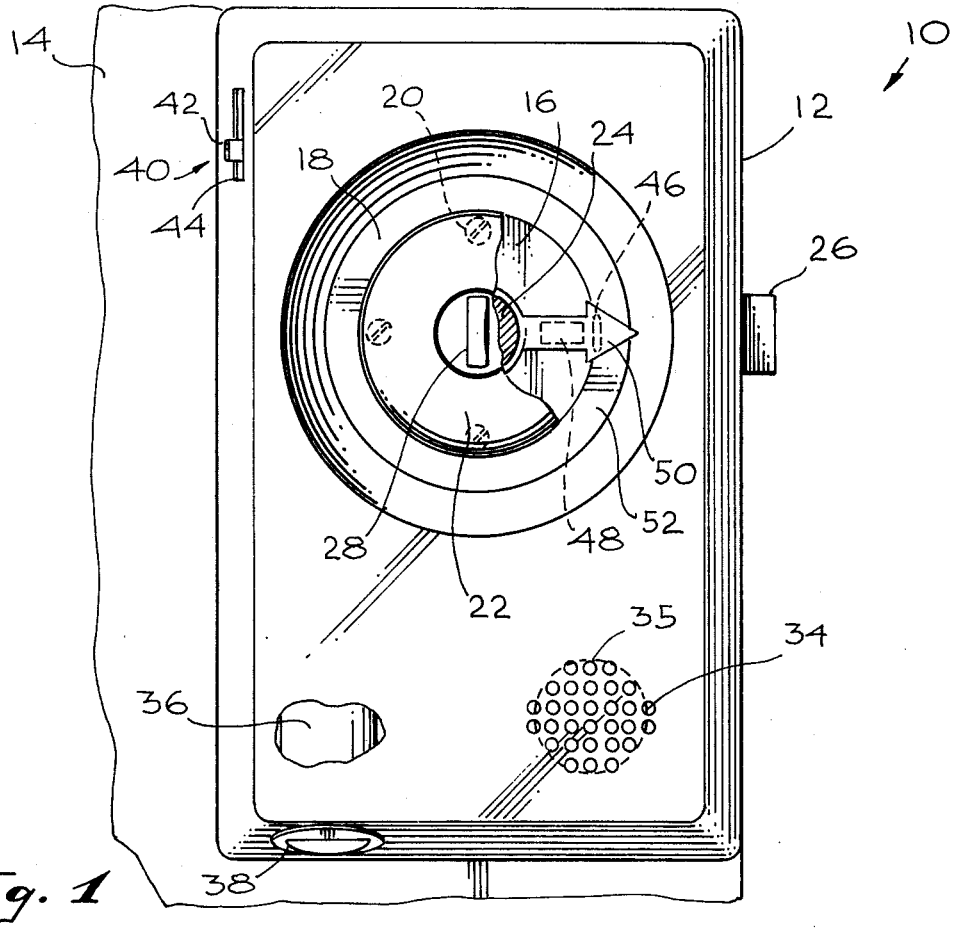
FIG. 1 is a schematic front elevation of a first preferred embodiment of the improved burglar alarm system of the present invention, partly broken away to illustrate certain internal features.

Now referring more particularly to FIG. 1, a preferred embodiment of the present improved burglar alarm system is schematically depicted. In this regard, system 10 is shown which includes a generally rectangular hollow housing 12 secured to the side of a door 14 by means of a cover disc or circular plate 16 which overlies a portion 18 of housing 12 and is in turn secured to door 14 by screws 20 extending through apertures (not shown) in plate 16.

Housing 12 has an aperture (not shown) through which doorknob 22 and its shaft 24 outwardly project, as shown in FIG. 1 for rotation thereof. Such rotation of knob 22 operates a standard doorlatch mechanism (which includes a tongue 26) to permit opening and closing of door 14, and knob 22 can be locked against rotation by lock 28.

Figure 2:
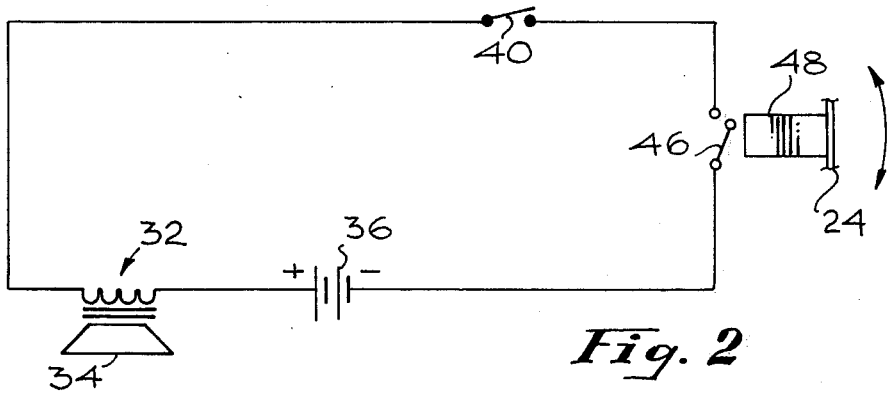
FIG. 2 is a schematic illustrating the electrical circuit utilized in the system of FIG. 1.

An electrical alarm circuit 30 is disposed within housing 12 and generally comprises that schematically depicted in FIG. 2. Thus, circuit 30 includes an annunciator 32, for example a horn 34, or buzzer (not shown) etc., positioned behind a perforated grill portion 35 of housing 12 and electrically powered by a portable power means in the form of a dry cell or battery 36 or the like, for example a standard 1.5 volt D size dry cell. An aperture (not shown) is disposed through housing 12 and is provided with a removable screw-type cap 38 so that when housing 12 is in place on door 14, battery 36 can be replaced.

An "off-on" slide switch 40 or the like is placed in circuit 30 so as to electrically interconnect horn 34 and battery 36 only when switch 40 is in the "on" position, thus activating circuit 30. Switch 40 includes a lever 42 extending outwardly through an aperture 44 in housing 12 and useful for setting switch 40 to the "off" or "on" position.

A second switch 46 is also in circuit 30. Switch 46 is normally closed to complete circuit 30 but is magnetically responsive, being held open (thus breaking circuit 30) by the close proximity of a magnet 48 installed on shaft 24 and rotatable therewith. Switch 46 may be, for example, a simple inexpensive reed switch, such as one having the following electrical characteristics: 1A., 120V., and 25W max.

Switch 46 is aligned in housing 12 so that it is held open only when doorknob shaft 24 is in its normal fully unrotated resting position. In such position, as shown in FIG. 1, magnet 48 is close to switch 46. However, when shaft 24 is rotated in *either* direction, (see arrows of FIG. 2), magnet 48 moves out of proximity to switch 46 and switch 46 automatically closes. This completes circuit 30 (provided that switch 40 is in the "on" position), thereby causing horn 34 to sound, and thus raising an alarm.

When system 10 is to be activated, it is first desirable to check to see that knob 22 and shaft 24 are in the fully unrotated resting position. Otherwise, horn 34 may sound when switch lever 42 is moved to the "on" position. Most doorknob and shaft assemblies have sufficient play in them so that upon their release after their rotation they do not necessarily return completely to the fully unrotated resting position. The desired check can be made visually because a decorative pointer 50 overlies and conceals unsightly magnet 48, is secured to shaft 24 for turning therewith and extends outwardly therefrom. Pointer 50 is in a horizontal position (FIG. 1) when shaft 24 is in desired fully unrotated position and is of sufficient length so as to be easily viewable around doorknob 22 (as shown in FIG. 1). Pointer 50 is external of and clears housing 12 because housing 12 is dished down in an area 52 around knob 22 (FIG. 1).

Figure 3:
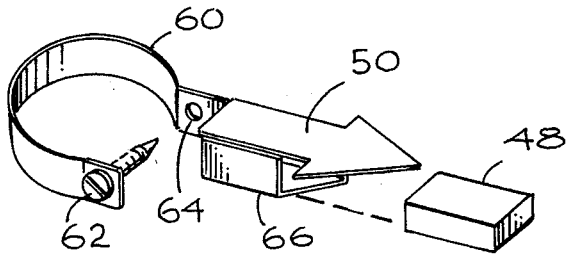
FIG. 3 is a perspective view of a portion of the embodiment of FIG. 1 showing the mounting arrangement therefor.

An arrangement for mounting the magnet 48 and associated pointer 50 is particularly shown in FIG. 3. This figure shows a collar 60 of thin sheet metal or plastic having sufficient flexibility to permit the collar 60 to be extended around the shaft 24 between the doorknob 22 and the associated door with attached housing 12. A fastener 62, such as a sheetmetal screw, is provided for securing the free end of the collar 60 back on itself through an opening 64. A bracket 66 is attached to the collar 60 for mounting the magnet 48 and supporting the decorative arrow and cover 50 to conceal the magnet 48 from view. The arrangement of FIG. 3 will be secured on the doorknob 22 and shaft 24 with an orientation such that the pointer 50 with the associated magnet 48 is directed toward the position of the magnetic reed switch 46 in the housing 12 (horizontally in the arrangement shown in FIG. 1).

After making the described visual check, and any necessary adjustment position of shaft 24, system 10 is then activated by moving lever 42 to the "on" position. Thereafter, if knob 22 and shaft 24 are turned, as by a burglar, switch 46 is closed, horn 34 sounds and gives the desired alarm. Device 10 can be deactivated merely by moving lever 42 to the "off" position. Thus, device 10 is of improved simplified design, circuitry and effectiveness, and yet it is inexpensive, durable and attractive in appearance.

Although there has been described above one particular arrangement of an improved burglar alarm system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. An improved burglar alarm system for mounting about the rotatable shaft of a doorknob attached to a door, said system comprising in combination:

a housing for mounting to the door over the doorknob with the shaft extending outwardly from the housing through an opening in the housing;

an electrical circuit disposed in said housing and including an annunciator, a power source, a power switch and a normally closed magnet-responsive switch connected in series circuit, the magnet-responsive switch being operative, when activated by a magnet, to open said circuit;

means for mounting the magnet-responsive switch in a predetermined position in the housing for activation by an associated magnet; and a magnet for mounting on said shaft for rotation therewith opposite and closely adjacent said predetermined position to open the normally closed magnet-responsive switch only when said shaft is in a resting unrotated position and to free the magnet-responsive switch to close the circuit when the doorknob and shaft are rotated in either direction out of the resting position.

2. The improved system of claim 1 further including indicator means for mounting adjacent said shaft and viewable outside of said housing for indicating the resting unrotated position of said shaft.

3. The improved system of claim 1 wherein the power switch is accessible from outside the housing.

4. The improved system of claim 2 wherein said indicator means includes a component for attaching to said shaft.

5. The improved system of claim 4 wherein said indicator means component is secured over said magnet to conceal the same.

6. The improved system of claim 5 wherein said indicator means component comprises a pointer for projecting from said shaft in line with said predetermined position when said shaft is in said resting unrotated position.

7. The improved system of claim 6 wherein said magnet-responsive switch is a magnetic reed switch closable when said shaft is rotated in either direction from said resting position.

8. The improved system of claim 7 wherein said power source comprises a battery accessible through a port in said housing.

* * * * *